US007028921B2

(12) United States Patent
Bhatia

(10) Patent No.: US 7,028,921 B2
(45) Date of Patent: Apr. 18, 2006

(54) CATALYST SOLUTION DISPENSER FOR A HAND-HELD LIQUID SPRAYING APPARATUS

(75) Inventor: Kamlesh Kumar Bhatia, Newark, DE (US)

(73) Assignee: E.I. duPont de Nemours and Company, Wilmington, DE (US)

( * ) Notice: Subject to any disclaimer, the term of this patent is extended or adjusted under 35 U.S.C. 154(b) by 89 days.

(21) Appl. No.: 10/869,677

(22) Filed: Jun. 16, 2004

(65) Prior Publication Data

US 2005/0279861 A1 Dec. 22, 2005

(51) Int. Cl.

| | |
|---|---|
| ***A62C 13/62*** | (2006.01) |
| ***A63C 13/66*** | (2006.01) |
| ***A63C 35/58*** | (2006.01) |
| ***B05B 9/03*** | (2006.01) |

(52) U.S. Cl. ..... 239/302; 239/303; 239/306; 239/309; 239/310; 239/366; 239/379

(58) Field of Classification Search ..... 239/302, 239/306, 309, 310, 366, 376, 379
See application file for complete search history.

(56) References Cited

U.S. PATENT DOCUMENTS

| | | | | |
|---|---|---|---|---|
| 3,437,242 | A * | 4/1969 | Poitras | 222/135 |
| 5,260,101 | A * | 11/1993 | Larson et al. | 427/388.2 |
| 5,899,362 | A | 5/1999 | Moran | |
| 6,187,711 | B1 | 2/2001 | Bernard et al. | |
| 6,230,987 | B1 * | 5/2001 | Truong | 239/310 |
| 6,383,572 | B1 * | 5/2002 | De Graaf et al. | 427/427.2 |
| 6,585,173 | B1 * | 7/2003 | Schmon et al. | 239/526 |
| 6,598,762 | B1 | 7/2003 | McKune | |
| 6,712,292 | B1 * | 3/2004 | Gosis et al. | 239/345 |

FOREIGN PATENT DOCUMENTS

| | | |
|---|---|---|
| WO | WO 00/55263 A1 | 9/2000 |
| WO | WO 00/68331 A1 | 11/2000 |

OTHER PUBLICATIONS

General Manual for Gravity Feed Paint Spray Gun, Model No. ASP550, Sep. 1999, DeVilbiss Air Power Company, p. 7, parts breakdown.*

W. Clark Still, Stannylation/Destannylation. Preparation of a-Alkoxy Organolithium Reagents and Synthesis of Dendrolasin via a Carbinyl Carbanion Equivalent, American Chemical Society, 1978, pp. 1481-1486, 100, U.S.A.

Masanori Kosugi, Hiroyuki Naka, Hiroshi Sano, and Toshihiko Migita, Preparation and Some Properties of Acyltin Compounds, NOTES Bull. Chem. Soc. Japan, 1987, pp 3462-3464, 60 No. 9, Japan.

(Continued)

*Primary Examiner*—David A. Scherbel
*Assistant Examiner*—James S. Hogan
(74) *Attorney, Agent, or Firm*—George M. Medwick

(57) ABSTRACT

A dispenser for dispensing a polymerization catalyst solution into a liquid coating formulation has a cross sectional area "a" given by the relationship:

$$a \cong P \cdot A \cdot [W/w] \cdot 10^{-6},$$

where

"A" is the cross sectional area of the reservoir holding a liquid coating formulation having "W" weight percent of solids;

"w" is the weight percent of catalyst in the dispenser; and

P is the ratio by weight of the catalyst to the solids desired in the finished coating, in parts per million.

19 Claims, 4 Drawing Sheets

OTHER PUBLICATIONS

Bernard Jousseaume, Nicolas Noiret, Michel Pereyre, and Annie Saux, Air Activated Organotin Catalysts for Silicone Curing and Polyurethane Preparation, Organometallics, 1994, pp. 1034-1038, 13, No. 3, American Chemical Society, U.S.A.

Rama K. Bhatt, Jianhua Ye, and J.R. Falck, Convenient Preparation of a-Trimethylsilyloxy- and a-Hydroxystannanes from Aldehydes, Tetrahedron Letters, 1994, pp. 4081-4084, 35, No. 24, Elsevier Science Ltd., Great Britain.

A. Clark,I. Coldham,G.T. Crisp,C. Diaper,P.A.C. Eagle,P.J. Guiry,B. Jousseaume,R. Marshall,P. McCormack,M.G. Moloney,R. Okazaki,K. Oshima,J. Podlech,A.C. Spivey,N. Takeda,E.J. Thomas,P. Thornton,N. Tokitob,G.P. Vennall, M. Wood.P.B. Wyatt, D. Young, Science of Synthesis, Houben-Weyl Methods of Molecular Transformation Organometallis, 2003, pp. 422-432 5 Georg Thieme Verlag Stuttgart, New York.

* cited by examiner

CATALYST SOLUTION DISPENSER FOR A HAND-HELD LIQUID SPRAYING APPARATUS

CROSS REFERENCE TO RELATED APPLICATIONS

Subject matter disclosed herein may be disclosed and claimed in the following copending applications, all assigned to the assignee of the present invention:

"Method For Introducing A Catalyst Solution Into A Coating Formulation", Ser. No. 10/869,646, (CL-2673), filed in the name of Kamlesh Bhatia; and "Coating Formulation Kit Including A Catalyst Solution Dispenser For A Hand-Held Liquid Spraying Apparatus", Ser. No. 10/869,702, (CL-2674), filed in the name of Kamlesh Bhatia.

BACKGROUND OF THE INVENTION

1. Field of the Invention

This invention relates to a catalyst solution dispenser for dispensing a catalyst solution into a coating formulation as the formulation is applied to a surface using a hand-held liquid spraying apparatus.

2. Description of the Prior Art

Automobile refinish clearcoats typically comprise a three-dimensional cross-linked polymer formed by two major reactive components. One component comprises polyol oligimers with multiple hydroxl end groups. The other component comprises organic molecules having isocyanate functional groups, such as a trimer of hexamethylene di-isocyanate. This hydroxyl-isocyanate chemistry is also employed for certain primers as well as for monocoats.

These two components are generally packaged as separate formulations in a volatile solvent, such as ethyl acetate, and are sold in separate containers.

At least one of the component formulations, usually the one having the hydroxyl oligomers, also contains a polymerization catalyst, such as dibutyl tin di-laurate, DBTBL. The catalyst promotes the rate of polymerization when the two components are mixed. The volatile solvent reduces viscosity for effective spraying. The formulations may also include relatively minor amounts of additives such as viscosity modifiers and/or retarders of catalytic activity.

In the spraying technology practiced currently in refinish shops the two component formulations are mixed prior to spraying and placed in a cup-like reservoir that is attached to a hand-held spraying apparatus. Due to the presence of catalyst, polymerization begins as soon as the component formulations are mixed. Thus, the viscosity of the mixture increases both before and while it is being sprayed.

The time it takes for the viscosity to increase to a point where spraying becomes ineffective, generally a two-fold increase in about thirty (30) minutes, is termed "pot life". There is available only a relatively short time window before the mixture becomes unusable. The possibility that the spray gun itself may become clogged with cured material is also disadvantageous.

One way to extend pot life is to add a greater amount of thinning solvent to the mixture. However, thinning agents contribute to increased emissions of volatile organic compounds and also increase the curing time. Thus, this alternative is not particularly attractive.

Other prior art attempts to extend pot life of the coating formulation have focused on "chemical-based" solutions.

For example, it has been suggested to include in the component formulation(s) certain additives that would retard polymerization in the mixing pot. However, the additives must be such that the rate of curing is not adversely affected after the coating is applied to the surface.

These chemical-based solutions may increase pot life to some degree. For example, clearcoats sold by E. I. Du Pont de Nemours and Company have a pot life of about one (1) to two (2) hours. Another suggested alternative is to include relatively inactive catalysts, which becomes active form upon exposure to air after atomization.

Accordingly, in view of the foregoing it is believed advantageous to extend pot life of the coating formulation [on the order of four (4) to seven (7) hours] in a way that does not increase volatile organics in the formulation and does not delay the curing of the applied coating.

SUMMARY OF THE INVENTION

The present invention is directed to a dispenser for dispensing a catalyst solution into a liquid coating formulation. The dispenser is adapted for use with a spraying apparatus that applies the liquid coating formulation to a surface to produce a finished coating.

The spraying apparatus has a housing with a flow channel extending therethrough and a reservoir for holding the liquid coating formulation. The reservoir is open to the atmosphere and is in fluid communication with the flow channel. The reservoir has a cross sectional area "A" and receives the coating formulation having "W" weight percent of solids therein.

The dispenser takes the form of a generally tubular body member having a closure at both a first and a second end. Preferably the dispenser is in the form of a right circular cylinder over substantially its entire length. Also, in the preferred case, the closure at the outlet end of the dispenser is a closure that is unable to be reclosed. However, the closure at the opposite end of the dispenser is preferably reclosable.

The dispenser holds a predetermined volume of a polymerization catalyst solution having "w" weight percent of catalyst therein. The tubular body member has a predetermined cross sectional area "a".

In accordance with the present invention the cross sectional area "a" is given by the relationship:

$$a \approx P \cdot A \cdot [W/w] \cdot 10^{-6},$$

where P is the ratio by weight of the catalyst to the solids desired in the finished coating, in parts per million, In use, after opening of the closure at the first end thereof, the dispenser is insertable into the reservoir to place the first end thereof in fluid communication with the flow channel. After such insertion and opening of the closure at the second end, the liquid head of the liquid coating formulation in the reservoir prevents flow of the catalyst solution from the dispenser until the liquid coating formulation flows from the reservoir into the flow channel. Thus, the catalyst solution mixes with the coating formulation in a way that a predetermined concentration of the catalyst solution is maintained in the coating formulation as the coating formulation flows from the reservoir.

In another aspect the present invention is directed toward the combination of the hand-held spraying apparatus and the dispenser.

BRIEF DESCRIPTION OF THE DRAWINGS

The invention will be more fully understood from the following detailed description taken in connection with the accompanying drawings, which form a part of this application and in which.

DETAILED DESCRIPTION OF THE INVENTION

Figure 1A:
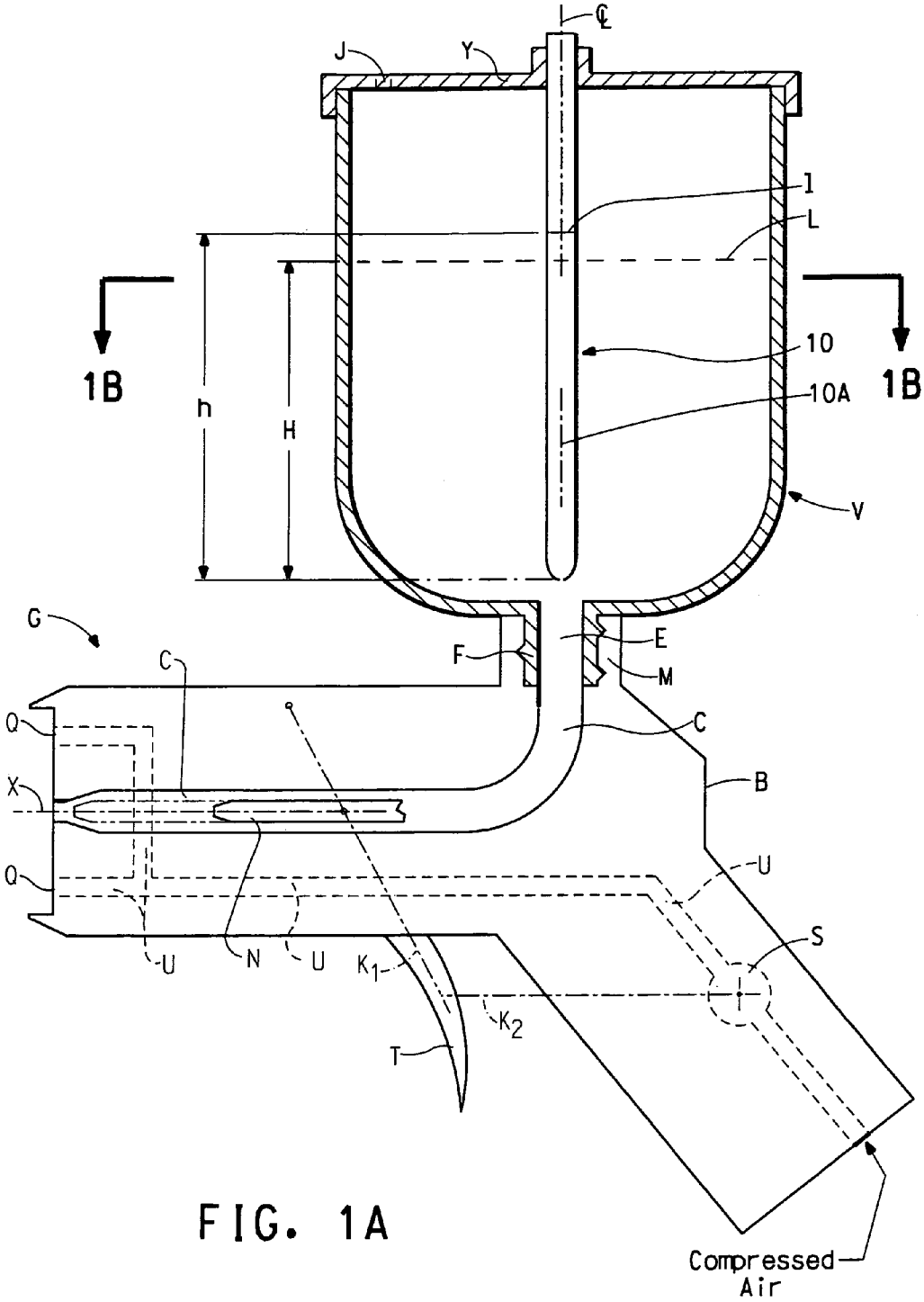
FIG. 1A is a stylized side elevational view, in section.

Throughout the following detailed description similar reference numerals refer to similar elements in all figures of the drawings.

Figure 2:
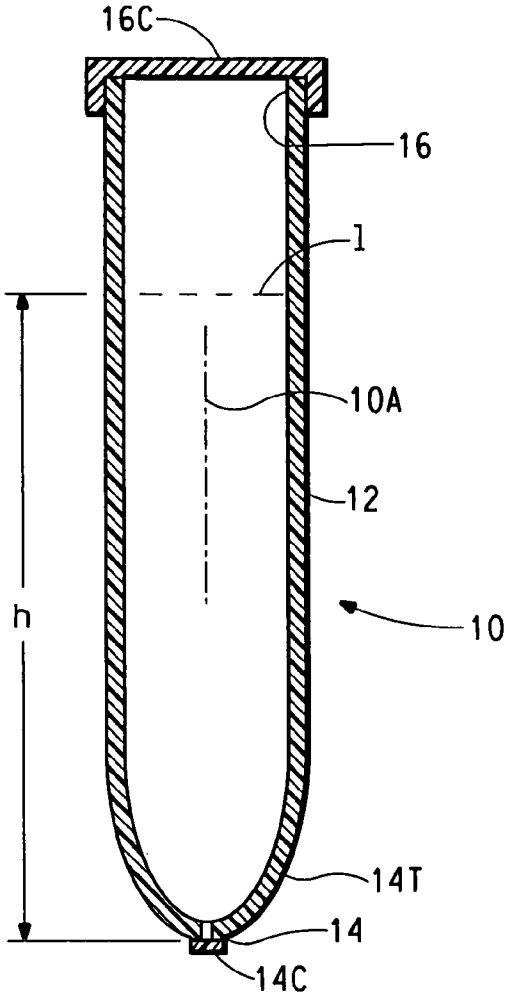
FIG. 2 is a side elevational view, in section, showing a catalyst solution dispenser in accordance with the present invention.
Figure 1B:
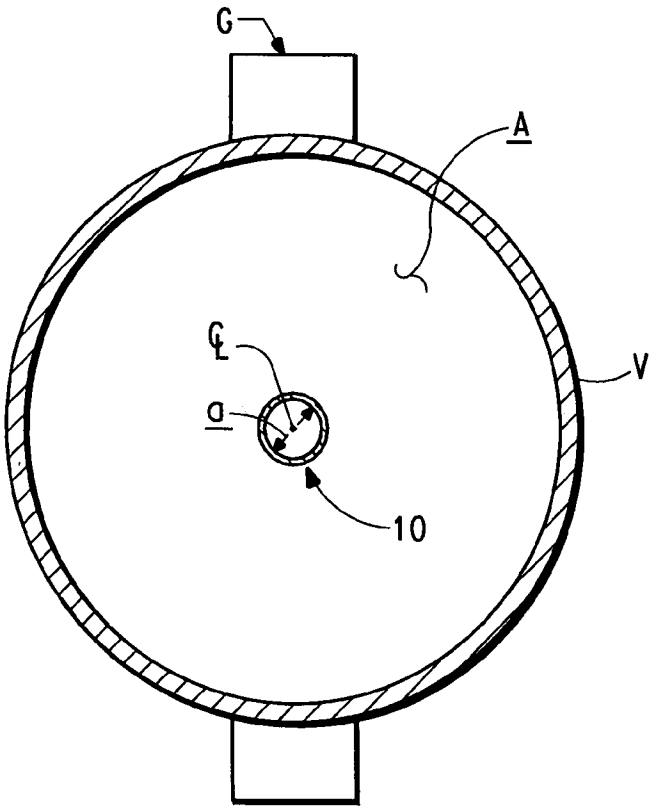
FIG. 1B is a section view (taken along section lines 1B—1B in FIG. 1A) both showing a hand-held spraying apparatus with which a catalyst solution dispenser in accordance with the present invention may be utilized.

Shown in FIGS. 1A and 1B is a highly stylized diagrammatic illustration of a prior art hand-held spraying apparatus, or spray gun, G for applying to a surface a multi-component liquid coating formulation of the type that requires a liquid polymerization catalyst solution. A dispenser 10 in accordance with the present invention for dispensing the polymerization catalyst solution into the coating formulation is shown in its operational disposition within the spray gun G. FIG. 2 is an isolated view of the dispenser 10 prior to use. The conventional elements of the spray gun G are indicated herein by alphabetic reference characters. Spray guns of the type to be described are available from various manufacturers, including DeVilbiss Air Power Company, Jackson, Tenn.

The spray gun G includes a housing, or body, B through which extends a flow channel C. A portion of the housing defines a threaded mounting receptacle M. The narrow outlet end of the channel C, typically sized in the range from about 0.8 to about 2.0 millimeters, is closed by movable needle valve N. Air ducts U extend through the housing B and terminate in atomizing openings Q located adjacent the outlet end of the channel C. A flow valve S is operative to control the passage of motive fluid through the ducts U. A trigger T is operatively linked, as suggested diagrammatically by the reference characters $K_1$, $K_2$, to control the actuation of both the needle valve N and the flow valve S.

The liquid coating formulation to be applied to the surface is held in a cup-like liquid holding reservoir generally indicated by reference character V. The reservoir V has an outlet E located at the bottom center thereof. A threaded mounting fitting F is formed on the lower portion of the reservoir V. The threads on the mounting fitting F engage the threads of the mounting receptacle M thereby to mount the reservoir V to the housing B of the spray gun G. When mounted to the spray gun G the outlet E is in fluid communication with the flow channel C. The reservoir V may be covered by a cover Y, if desired. The cover Y has a vent opening J provided therein through which the reservoir communicates with the atmosphere.

For clarity of illustration the reservoir V is shown in FIG. 1A as mounted with its the central axis CL perpendicular with respect to the axis X of the flow channel C. However, it should be understood that in the typical case the reservoir V is mounted such that the central axis CL of the reservoir inclines rearwardly with respect to the axis X of the flow channel C near the outlet end thereof.

In FIG. 1A the upper level of the coating formulation within the reservoir V is indicated by the reference character L. The liquid coating formulation has "W" weight percent of solids therein. By "solids" it is meant those nonvolatile species that constitute the cured, solid finished coating on the surface (after polymerization and volatilization of all volatile organic compounds).

In the typical case the interior of the reservoir V is generally cylindrical in shape over substantially the major portion of its height. It should be understood, however, that the dispenser 10 of the present invention might be used with a reservoir of any convenient shape. The cross-sectional area (FIG. 1B) of the reservoir V is indicated by the reference character A and is defined as that area in a plane perpendicular to the geometric central axis CL of the reservoir V. The central axis CL is that line that includes both the geometric center of the open upper end of the reservoir V and the geometric center of the outlet E.

The theory and operation of air-assisted spray guns are explained in Lefebvre, *Atomization and Sprays*, Hemisphere Publications, New York, 1989. In general, the spray gun G is connected to a source of pressurized motive fluid, such as compressed air, through a suitable connection. Actuation of the trigger T substantially simultaneously withdraws the needle valve N from the outlet end of the flow channel C (over the linkage $K_1$) and opens the valve S (over the linkage $K_2$). Opening of the needle valve N permits liquid coating formulation to flow by gravity from the reservoir V into the flow channel C. Opening of the flow valve S permits motive fluid from the source to flow as high velocity jets through the atomizing openings Q. The high velocity motive fluid flowing through the openings Q assists in atomizing the liquid coating formulation into a fine spray and propelling the same toward the surface to be coated.

A hand-held spray gun G is especially useful in auto body repair shops for applying a bi-component coating comprising isocyanate and hydroxyl-end group moieties, such as a cross-linked clearcoat, to a surface. As noted earlier it is the prior practice to pre-mix the component formulation containing the hydroxyl-end groups with the component formulation containing the isocyanate groups (also known as the activator) and to charge that mixture into the reservoir V. Since at least one of the component formulations includes a catalyst, a polymerization reaction is initiated the moment the two components mix together. This reaction continues within the reservoir V with the deleterious consequences outlined above.

However, using the dispenser 10 of the present invention the catalyst is kept separate and is not premixed with the components of the liquid coating formulation. As is discussed more fully in connection with FIGS. 3A through 3C the dispenser 10 is positioned with respect to the reservoir V such that the catalyst solution is dispensed into the coating formulation as the coating formulation flows from the reservoir into the flow channel C of the spray gun G.

The structure of the dispenser 10 prior to use is shown in FIG. 2. The dispenser 10 takes the form of a tubular body member 12 having a first end 14 and a second end 16. The body member can be formed of glass, plastic or other suitable material. Transparent ("see-through") plastic material with low suface interaction with the catalyst is preferred for ease of use and minimal miniscus in the dispenser.

One end 14, the end that defines the outlet end that is insertable into the reservoir V, is tapered as at 14T, to conform to the general shape of the reservoir V in the vicinity of the outlet E.

As seen in FIG. 2 each of the ends 14, 16 is closed by a suitable closure 14C, 16C, respectively. One or both of the closure(s) may be reclosable (rendering the dispenser capable of multiple uses) and/or once usable (thereafter rendering the dispenser incapable of further use), as desired. Preferably the closure 14C is of a form that once opened is incapable of being re-closed. The closure 16C at the second end 16 is preferably a removable and re-closable closure.

The dispenser 10 has a cross-section of any predetermined shape. Preferably, the cross-section is in the form of a right circular cylinder over the majority of its length. The dispenser 10 exhibits a predetermined cross sectional area indicated by the reference character "a" (FIG. 1B). The cross sectional area "a" is that cross-sectional area that lies in a plane that is perpendicular to the axis 10A of the dispenser 10.

The dispenser 10 is charged with a predetermined volume of the catalyst solution having a predetermined weight percent "w" of catalyst therein. When so charged the level "l" of the catalyst solution within the dispenser 10 extends a predetermined distance "h" above the outlet end 14 (FIG. 1A). The level L of the coating formulation in the reservoir V lies a distance "H" above the same datum.

With the density of the polymerization catalyst solution is indicated by the character "r", and with the density of the polymerization catalyst solution is indicated by the character "R", these densities and the heights "H" and "h" satisfy the relationship:

$$h \cdot r = H \cdot R.$$

It is preferred that, as far as possible, the densities "r" and "R" should be as close as possible to each other. If "r" and "R" are the same the heights "h" and "H" are equal. Otherwise the heights "H" and "h" are different.

In accordance with the present invention the dispenser 10 is configured such that the cross sectional area "a" (FIG. 1B) is given by the relationship:

$$a \approx P \cdot A \cdot [W/w] \cdot 10^{-6},$$

where P is the ratio by weight of the catalyst in the catalyst solution to the solids desired in the finished coating, in parts per million.

In practice the weight percent "w" of catalyst should be chosen such that the cross-sectional area "a" of a right circular cylindrical form of a dispenser 10 has a diameter in the range from about two (2) to about ten (10) millimeters, and more particularly, in the range from about three (3) to about seven (7) millimeters.

It should be noted that the above relationship for the cross sectional area "a" of the dispenser 10 is approximate in nature since it does not fully account for the fact that the full cross sectional area A of the reservoir V is not available for a liquid coating when the dispenser 10 disposed in the reservoir (as shown in FIGS. 1A and 1B). However, since the cross sectional area "a" of the dispenser 10 is very small in comparison with the cross sectional area A of the reservoir (by at least two orders of magnitude smaller) any error introduced by the approximation is not significant.

Figure 3C:
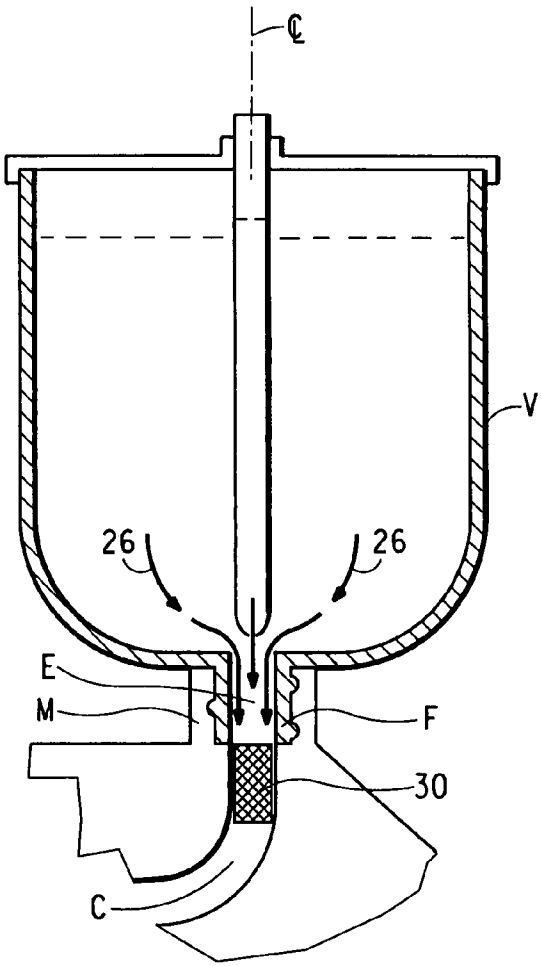
FIGS. 3A through 3C are diagrammatic illustrations of the steps in accordance with a method for using a catalyst solution dispenser to dispense a catalyst solution into a liquid coating formulation.
Figure 3B:
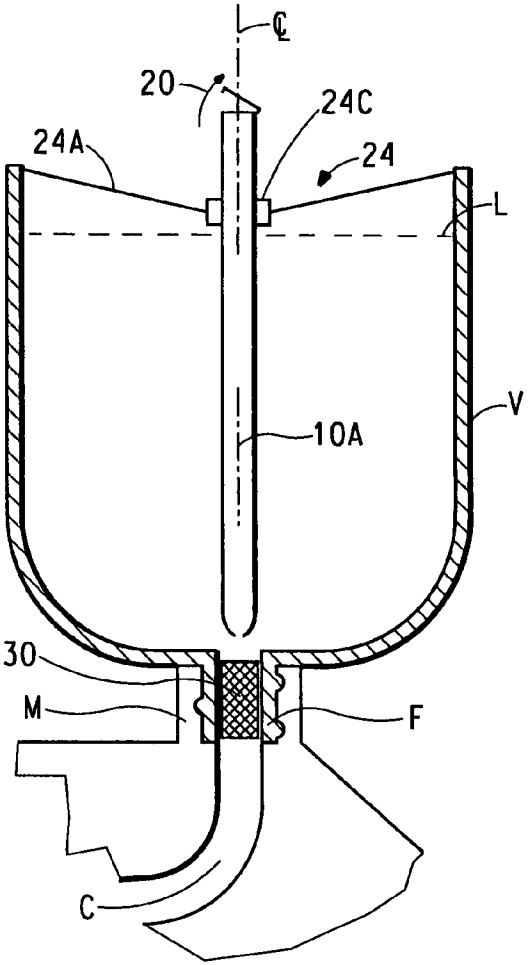
Figure 3A:
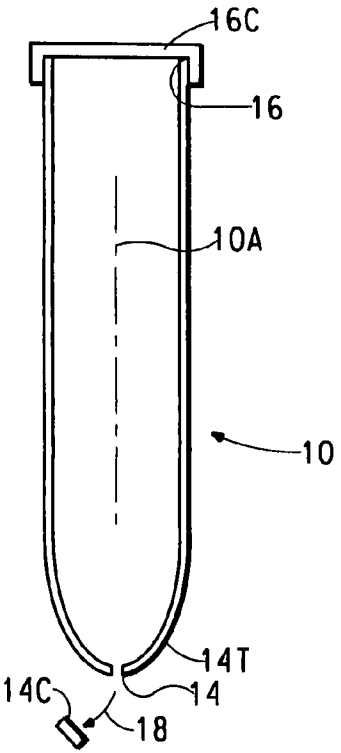

The method of dispensing the catalyst formulation from the dispenser 10 into the liquid coating formulation within the reservoir V may be understood with reference to the diagrammatic illustrations shown in FIGS. 3A through 3C. In these Figures the axis CL of the reservoir is also shown oriented perpendicular to the outlet axis X of the flow channel C for convenience of illustration. The same method steps are performed if the reservoir axis CL is rearwardly inclined.

The closure 14C at the first end 14 of the dispenser 10 is opened. This action is illustrated by reference character 18 in FIG. 3A. Because the second end 16 is still closed by the closure 16C atmospheric pressure prevents the catalyst solution from running from the dispenser 10.

Either before or after the closure 14C is removed a predetermined volume of the liquid coating formulation charged into the reservoir V to the level "L". With the closure 14C at the outlet end 14 of the dispenser 10 removed the dispenser 10 is inserted into the reservoir V such that the now-open end 14 of the dispenser 10 is below the level L of the coating formulation (FIG. 3B). The dispenser 10 is positioned in the reservoir V such that first end 14 thereof is near the outlet E (FIG. 3B). By "near" is it meant that the now-open outlet end 14 of the dispenser 10 may be positioned a convenient distance above the bottom of the reservoir V (adjacent to the mouth of the outlet E) or positioned within the passage (extending through the mounting fitting F) leading to the flow channel C. Care should be exercised that, regardless of where positioned, the dispenser 10 does not obstruct the outlet E of the reservoir. Also the dispenser 10 should be positioned in the reservoir to minimize the distance ("dead space") to the outlet end of the flow channel C.

For convinience and ease of mixing it is preferable that the dispenser 10 is positioned on the interior of the reservoir V such that the axis 10A of the dispenser 10 is parallel to the central axis CL of the reservoir. More preferably, the dispenser 10 is position so that its axis 10A is collinear with the central axis CL of the reservoir V.

With the open first end of the dispenser 10 positioned near the outlet E of the reservoir V the closure 16C at the second end 16 of the dispenser 10 is opened to atmosphere, as indicated by the reference character 20.

The dispenser 10 is held in the desired position by a suitable support structure 24 (FIG. 3B). The support structure may take the form of a web-like member having a central collar 24C that accepts the dispenser and radiating arms 24A that attach to the lip of the reservoir V. Alternatively, the cover Y over the open end of the reservoir V may be used to support the dispenser in the desired position.

The liquid head of the liquid coating formulation in the reservoir V prevents flow of the catalyst solution from the dispenser 10 until the liquid coating formulation flows from the reservoir into the flow channel. Thus, aside from the immediate vicinity of the interface between the catalyst solution and the liquid coating formulation at the open end of the dispenser and in the dead space leading to the end of the flow channel the catalyst remains isolated from the coating formulation. {Prior to the initiation of flow of catalyst from the dispenser, the relatively small volume of the coating formulation initially in the dead space [on the order of about six (6) cc] does not contain any catalyst. However, this small volume is flushed during the initial few seconds required to adjust the gun.}

It is only as the liquid coating formulation flows by gravity from the reservoir V into the flow channel C (as indicated at reference character 26, FIG. 3C) that the catalyst flows from the dispenser (as indicated by reference character 28, FIG. 3C) and mixing between the catalyst and the coating formulation can occur. As the liquid coating formulation flows from the reservoir V the catalyst solution flows from the dispenser 10 in a proportionate amount. The catalyst solution mixes with the liquid coating formulation only as the liquid coating formulation leaves the reservoir V.

Owing to the relationship between the cross sectional areas and the weights of the coating formulation and the catalyst solution a desired predetermined concentration of the catalyst solution is metered into the coating formulation as the coating formulation flows from the reservoir. Thus, a predetermined concentration of the catalyst solution is maintained for all rates at which the catalyst may flow from the reservoir. Slight variations in the catalyst concentration that may occur are to be construed as lying within the contemplation of the present invention.

The catalyst is formulated, preferably with the solvent used in the coating, to make a solution of nearly the same density as that of the coating formulation. Thereby, the level in the capillary stays about the same as the level in the reservoir. The diluted catalyst solution also facillitates mixing.

To assist further in mixing of the catalyst with the coating formulation a static mixing element 30 may be located within the mounting receptacle M of the reservoir (FIG. 3B) or in the housing B of the spray gun G downstream of the outlet E of the reservoir (FIG. 3C). It should be understood that in those instances where the spray gun includes a sieve or a filter element, that element may also serve to provide a mixing function to some degree.

Even if the reservoir V were inclined with respect to the axis X of the flow channel C (the usual case) so long as the dispenser 10 is disposed substantially along the center line CL of the reservoir V the liquid head of the coating formulation would act in the manner described to maintain the catalyst solution in the dispenser 10 and to dispense the catalyst into the coating formulation in the manner described.

EXAMPLE 1

This Example illustrates the design of a dispenser 10 in accordance with the present invention for use in a hand held spray gun for applying an automotive refinish clearcoat system. The spray gun has a nominal one (1) liter reservoir with an inside diameter of ten (10) centimeters. The coating formulation has forty percent (40%) by weight solids therein. It is desired that a DBTDL catalyst be incorporated into the coating at about four hundred parts-per-million (400 ppm) using a ten percent (10%) by weight catalyst solution.

Thus, W=40 w=10 P=400

$$A=(\pi\cdot 10^2)/4=78.54\ \text{cm}^2$$

In accordance with the present invention the area of the dispensing tube is given by the relationship:

$$a \cong P\cdot A\cdot[W/w]\cdot 10^{-6},$$

$$a \cong 100\cdot 78.54\cdot[40/10]\cdot 10^{-6},$$

$$a \cong 0.1257\ \text{cm}^2$$

The area "a" of the dispenser is very small in comparison to the area "A" of the reservoir. The area of the dispenser is (0.1257/78.54) or 1/625 of the reservoir area. For a right circular cylindrical dispenser this equates to an inner diameter of four millimeters (4 mm).

When positioned in the reservoir the first end of the dispenser is 12.4 cm below the level of the coating formulation in the reservoir.

Thus, H=12.4 cm.

The specific gravity of the coating formulation in the reservoir is 0.95 and that of the catalyst solution is 0.915.

The height "h" that ten percent by weight catalyst solution is above the outlet end of the dispenser is given by:

$$h=(H\cdot R)/r$$
$$=(12.4\cdot 0.95)/0.915$$
$$h=12.9\ \text{cm}.$$

Figure 4:
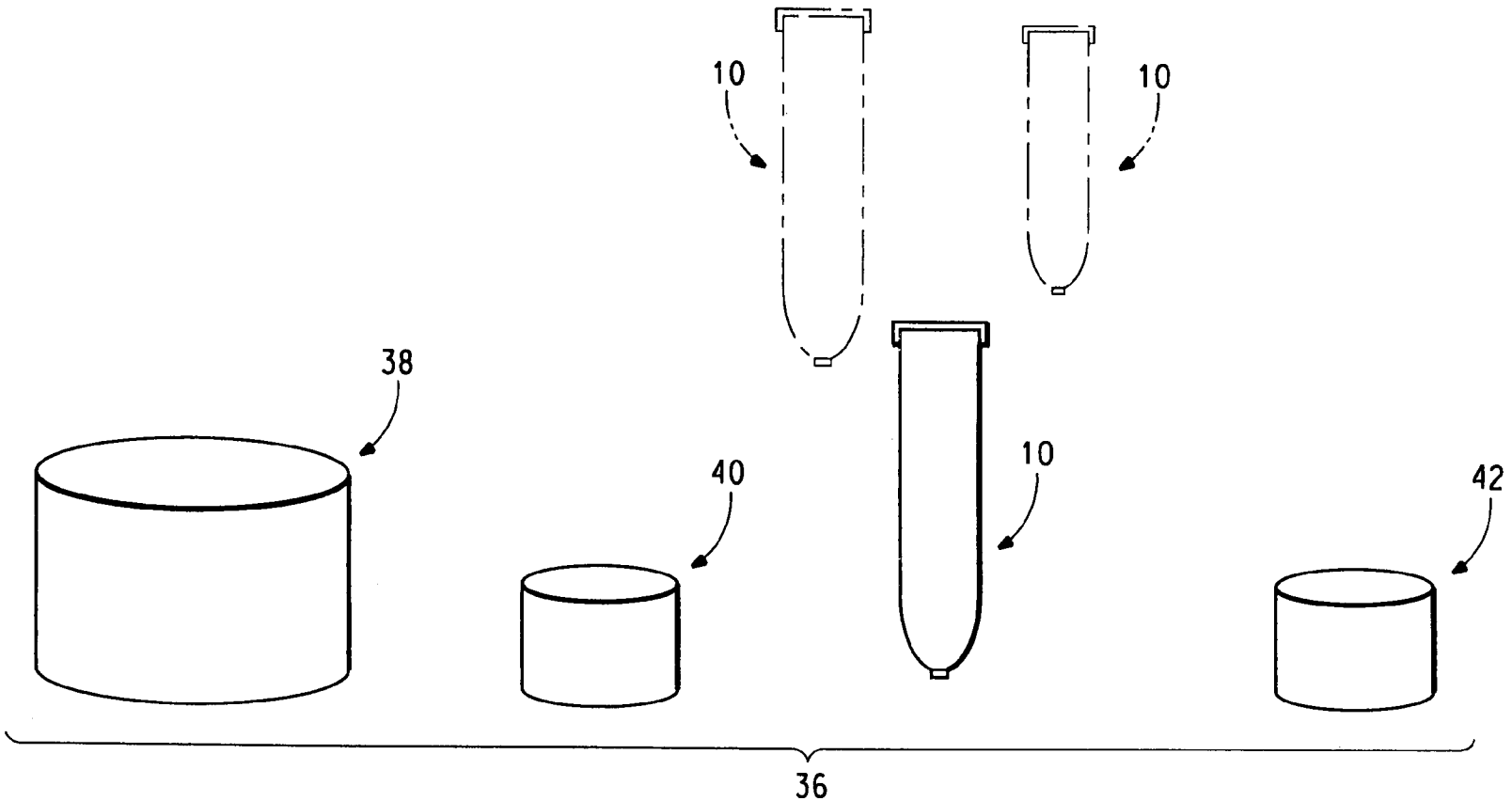
FIG. 4 is a diagrammatic illustration of a coating formulation kit that includes a catalyst solution dispenser for dispensing a catalyst solution into a liquid coating formulation.

In another aspect the present invention relates to a kit 36 for forming a multi-component coating formulation for application using a hand-held spraying apparatus G as shown in FIG. 1. As illustrated in FIG. 4 the kit 36 comprises a first container 38 holding a predetermined volume of a first component formulation of the coating (such as the hydroxyl-end group formulation), a second container 40 holding a predetermined volume of a second component formulation (such as the isocyanate group formulation). The kit 36 also includes one or more dispenser(s) 10 configured in the manner discussed and having a predetermined volume of the catalyst solution therein.

Of course, if the coating includes additional component formulations (e.g., solvents) the necessary container(s) 42 holding such additional formulations are included in the kit. The container(s) 38, 40 (and 42) together with the dispenser(s) 10 comprising the kit 36 may be packaged in any convenient manner.

It is preferred that the volumes of the component formulations are in the desired predetermined ratio with respect to each other so that when mixed they produce the desired coating formulation. One advantage of the kit form of the invention is the fact that the various formulations are conveniently prepackaged in predetermined proportions that yield optimum results.

As may be appreciated from the foregoing the various aspects of the present invention overcome the necessity of pre-mixing catalyst solution into the coating formulation prior to the initiation of spraying. As a result the problem of short "pot life" and other limitations currently experienced during reservoir are avoided. Use of the present invention may increase pot life to as long as a full work shift (i.e., eight hours) or longer, providing a substantial productivity advantage in that the components of the coating formultion need be mixed only once, at the beginning of the work shift.

In accordance with the present invention, through the use of an appropriately sized dispenser, the catalyst solution is added in the appropriate ratio as the coating formulation flows into the spray gun. The ratio is maintained at all flow rates (within the operating range of the gun) without employing any flow-measuring or ratio control instruments. The flow is self-regulated by virtue of the fact that the level of catalyst in the dispenser follows the level of coating fomrulation in the cup.

Use of the present invention increases productivity, reduces waste and allows increased polymer loading, i.e., significantly reduces use of volatile thinning solvents/VOC emssions. It decouples the choice of optimum catalyst level from "pot life" considerations—for example, catalyst concentration can be increased to achieve faster curing, reduced buffing time and increased productivity.

Those skilled in the art, having the benefit of the teachings of the present invention as hereinabove set forth, may effect numerous modifications thereto. Such modifications are to be construed as lying within the contemplation of the present invention, as defined by the appended claims.

What is claimed is:

1. A dispenser for use in combination with a spraying apparatus for applying a liquid coating formulation to a surface to produce a finished coating, the liquid coating formulation having "W" weight percent of solids therein, the spraying apparatus having a housing with a flow channel extending therethrough and a reservoir for holding the liquid coating formulation, the reservoir being open to the atmosphere and being in fluid communication with the flow channel, the reservoir having a cross sectional area "A", wherein the dispenser comprises:

a generally tubular body member having a closure at both a first and a second end thereof, the dispenser holding a predetermined volume of a polymerization catalyst solution having "w" weight percent of catalyst therein, the tubular body member having a predetermined cross sectional area "a", wherein the cross sectional area "a" is given by the relationship:

$$a \cong P \cdot A \cdot [W/w] \cdot 10^{-6},$$

where P is the ratio by weight of the catalyst to the solids desired in the finished coating, in parts per million, so that, in use, after opening of the closure at the first end, when the dispenser is insertable into a liquid coating formulation in the reservoir to a position such that, after opening of the closure at the second end, the liquid head of the liquid coating formulation in the reservoir prevents flow of the catalyst solution from the dispenser until the liquid coating formulation flows from the reservoir into the flow channel, whereby the catalyst solution mixes with the coating formulation in a way that a predetermined concentration of the catalyst solution is maintained as the liquid coating formulation flows from the reservoir.

2. The dispenser of claim 1 further comprising a support member for holding the dispenser in a position centrally and axially disposed within the reservoir.

3. The dispenser of claim 1 wherein the tubular member has the form of a right circular cylinder over substantially its entire length.

4. The dispenser of claim 3 wherein the cross sectional area "a" is such that the tubular member has a diameter dimension in the range from about two (2) to about ten (10) millimeters.

5. The dispenser of claim 4 wherein the tubular member has a diameter dimension in the range from about three (3) to about seven (7) millimeters.

6. The dispenser of claim 1 wherein the closure at the first end of the tubular member is a closure that is unable to be reclosed.

7. The dispenser of claim 1 wherein the closure at the second end of the tubular member is removable and reclosable.

8. The dispenser of claim 1 wherein the closure at the both ends of the tubular member is a closure that is unable to be reclosed.

9. The dispenser of claim 1 wherein the closure at both ends of the tubular member is removable and reclosable.

10. The dispenser of claim 1 wherein the tubular member is fabricated of a transparent material.

11. A spraying apparatus for applying a liquid coating formulation to a surface to produce a finished coating, the liquid coating formulation having "W" weight percent of solids therein, the spraying apparatus comprising:

a housing with a flow channel extending therethrough;

a reservoir for holding the liquid coating formulation, the reservoir being open to the atmosphere and being in fluid communication with the flow channel, the reservoir having a cross sectional area "A", a catalyst solution dispenser disposed within the reservoir, the dispenser being in the form of a generally tubular body member having a closure at both a first and a second end thereof, the dispenser holding a predetermined volume of a polymerization catalyst solution having "w" weight percent of catalyst therein, the tubular body member having a predetermined cross sectional area "a", wherein the cross sectional area "a" is given by the relationship:

$$a \cong P \cdot A \cdot [W/w] \cdot 10^{-6},$$

where P is the ratio by weight of the catalyst to the solids desired in the finished coating, in parts per million, so that, in use, after opening of the closure at the first end, the dispenser is insertable into a liquid coating formulation in the reservoir to a position such that, after opening of the closure at the second end, the liquid head of the liquid coating formulation in the reservoir prevents flow of the catalyst solution from the dispenser until the liquid coating formulation flows from the reservoir into the flow channel, whereby the catalyst solution mixes with the coating formulation in a way that a predetermined concentration of the catalyst solution is maintained as the liquid coating formulation flows from the reservoir.

12. The spraying apparatus of claim 11 further comprising a support member for holding the dispenser in a position centrally and axially disposed within the reservoir.

13. The spraying apparatus of claim 11 wherein the tubular member has the form of a right circular cylinder over substantially its entire length.

14. The spraying apparatus of claim 13 wherein the cross sectional area "a" is such that the tubular member has a diameter dimension in the range from about two (2) to about ten (10) millimeters.

15. The spraying apparatus of claim 14 wherein the tubular member has a diameter dimension in the range from about three (3) to about seven (7) millimeters.

16. The spraying apparatus of claim 11 wherein the closure at the first end of the tubular member is a closure that is unable to be reclosed.

17. The spraying apparatus of claim 11 wherein the closure at the second end of the tubular member is removable and reclosable.

18. The spraying apparatus of claim 11 further comprising a static mixer disposed in the housing at a position downstream of the reservoir.

19. The spraying apparatus of claim 11 wherein the reservoir has a mounting receptacle thereon, and further comprising a static mixer disposed in the mounting receptacle.

* * * * *